US010933297B2

(12) United States Patent
Anderssen et al.

(10) Patent No.: US 10,933,297 B2
(45) Date of Patent: Mar. 2, 2021

(54) MOUNTING PLATE AND MOUNTING PLATE SYSTEM FOR A SKI BINDING

(71) Applicant: ROTTEFELLA AS, Klokkarstua (NO)

(72) Inventors: Magnus Anderssen, Nesoddtangen (NO); Jorn Frode Danielsen, Drobak (NO); Thomas Goverud-Holm, Hoff (NO); Oyvar Svendsen, Oslo (NO)

(73) Assignee: Rottefella AS, Klokkarstua (NO)

( * ) Notice: Subject to any disclaimer, the term of this patent is extended or adjusted under 35 U.S.C. 154(b) by 0 days.

(21) Appl. No.: 16/483,603

(22) PCT Filed: Nov. 22, 2017

(86) PCT No.: PCT/NO2017/050303
§ 371 (c)(1),
(2) Date: Aug. 5, 2019

(87) PCT Pub. No.: WO2018/143815
PCT Pub. Date: Aug. 9, 2018

(65) Prior Publication Data

US 2020/0114248 A1 Apr. 16, 2020

(30) Foreign Application Priority Data

Feb. 3, 2017 (NO) ..... 20170170

(51) Int. Cl.
*A63C 9/00* (2012.01)
*A63C 9/086* (2012.01)
*A63C 9/20* (2012.01)

(52) U.S. Cl.
CPC ..... *A63C 9/086* (2013.01); *A63C 9/003* (2013.01); *A63C 9/005* (2013.01); *A63C 9/0053* (2019.05); *A63C 9/20* (2013.01); *A63C 2009/008* (2013.01)

(58) Field of Classification Search
CPC ..... A63C 5/128; A63C 2009/008
See application file for complete search history.

(56) References Cited

U.S. PATENT DOCUMENTS 5,480,175 A * 1/1996 Astier ..... A63C 5/075 280/602
5,785,342 A * 7/1998 Bronson ..... A63C 5/075 280/602

(Continued)

FOREIGN PATENT DOCUMENTS

CN 102470271 A 5/2012
CN 104797308 A 7/2015

(Continued)

OTHER PUBLICATIONS

International Search Report PCT/ISA/210 for International Application No. PCT/NO2017/050303 dated Mar. 9, 2018.

(Continued)

*Primary Examiner* — Brian L Swenson
(74) *Attorney, Agent, or Firm* — Harness, Dickey & Pierce, P.L.C.

(57) ABSTRACT

A mounting plate and mounting plate system for a ski comprising: a bottom surface configured to be placed against a ski; an upward directed left and right side edge along the outer sides of the mounting plate, where the edges have laterally opposed undercuts that are configured to hold a ski binding with complementary cuts fastened to the mounting plate in the vertical direction; a longitudinal groove, configured to hold a first interchangeable rail fixed in the lateral direction and the longitudinal direction, and a second interchangeable rail which can be interchanged with the first rail, fixed in a lateral direction but movable in the longitudinal direction.

27 Claims, 11 Drawing Sheets

(56) References Cited

U.S. PATENT DOCUMENTS

| | | | | |
|---|---|---|---|---|
| 9,776,065 | B2 * | 10/2017 | Bjertnaes | A63C 5/128 |
| 2007/0138765 | A1 * | 6/2007 | Miette | A63C 9/005 280/615 |
| 2008/0047168 | A1 | 2/2008 | Svensson | |
| 2008/0203703 | A1 | 8/2008 | Hauglin et al. | |
| 2014/0131980 | A1 | 5/2014 | Girard et al. | |
| 2014/0138936 | A1 * | 5/2014 | Favret | A63C 5/07 280/613 |

FOREIGN PATENT DOCUMENTS

| | | | |
|---|---|---|---|
| EP | 2090338 | B1 | 12/2013 |
| EP | 1958678 | B1 | 6/2016 |
| FR | 2684888 | A1 | 6/1993 |
| NO | 335244 | B1 | 10/2014 |
| NO | 20130873 | A1 | 12/2014 |
| NO | 340839 | B1 | 6/2017 |
| WO | WO-2006072812 | A1 | 7/2006 |
| WO | WO-2012036558 | A2 | 3/2012 |
| WO | WO-2012/045329 | A1 | 4/2012 |
| WO | WO-2012/045723 | A1 | 4/2012 |
| WO | WO-2012/036558 | A8 | 4/2013 |
| WO | WO-2014209130 | A1 | 12/2014 |

OTHER PUBLICATIONS

Written Opinion of the International Searching Authority PCT/ISA/237 for International Application No. PCT/NO2017/050303 dated Mar. 9, 2018.

Norwegian Search Report for Norwegian Patent Application No. 20170170 dated Aug. 7, 2017.

Chinese Office Action dated Nov. 30, 2020 for corresponding Chinese Application No. 201780087895.9, and English-language translation thereof.

* cited by examiner 662
651
DETAIL J
6b
6a
7
5, 5b
530
620c
710
601
SECTION E-E

520
SECTION F-F 652
663
620b
SECTION G-G 511b
510b
5, 5a
611b
611a
511a
510a
SECTION I-I 620a
640c
SECTION H-H

MOUNTING PLATE AND MOUNTING PLATE SYSTEM FOR A SKI BINDING

CROSS-REFERENCE TO RELATED APPLICATIONS

This application is a national phase under 35 U.S.C. § 371 of PCT International Application No. PCT/NO2017/050303 which has an International filing date of Nov. 22, 2017, which claims priority to Norwegian Patent Application No. 20170170, filed Feb. 3, 2017, the entire contents of each of which are hereby incorporated by reference.

TECHNICAL FIELD

The present invention relates to a mounting plate and a mounting plate system for attaching a ski binding to a ski, where the same mounting plate can be used by skiers with different needs as regards binding solutions.

BACKGROUND ART

Ski bindings have throughout time been attached to skis in a number of different ways. Earlier, the most common was to screw the bindings in place in the skis. If the bindings were damaged, or it was desirable to move the bindings, they had to be unscrewed and new ones screwed in place. This can affect the properties of the ski, and for a number of skis where weight and flexibility are of crucial importance, the area designated for attaching bindings in this way has been limited or eliminated.

Recently it has become more common to use mounting plates that are attached to the ski once, either by screwing the plate onto the ski, by gluing or a combination thereof.

The binding can then be attached to the ski and in some cases adjusted according to the user's physical characteristics, such as, e.g., weight and personal requirements.

Solutions have been proposed that allow the bindings to be adjusted in the longitudinal direction even after mounting. This will be an advantage where it is desirable to be able to make optimal use of the ski's glide and grip properties during a ski trip.

In this respect, there are both manual solutions for adjusting the ski binding, such as, e.g., moving a lever to alternate between two positions, turning a wheel, or an electric actuator capable of being controlled from the ski pole, which pushes the binding along the mounting plate.

Norwegian Patent 335244 teaches a mounting plate for a binding or parts thereof, such as a binding plate and/or heel plate. The mounting plate is designed to be attached to a ski. In the mounting plate there are provided locking channels 30, 31 and 36 for locking in the longitudinal direction a binding that is mounted on the mounting plate. The binding and the heel plate can be adjusted slightly in the longitudinal direction during mounting, but the binding cannot be adjusted in the longitudinal direction without taking the skis off.

WO2012045723A1 shows different embodiments of a ski binding that is adjustable in the longitudinal direction.

The forward part of the binding, referred to as the first unit 3, where the tip of the ski shoe is attached, is displaceably fastened in the longitudinal direction to a plate that is fastened onto the ski.

In FIG. 8, the second unit 4 is in this case equipped with a rotatable actuator 63 that can be rotated a half revolution between two positions, thereby enabling the first unit, and thus the ski shoe, to be moved between the two positions.

Norwegian Patent 340839B1 also teaches a ski binding that can be moved in the longitudinal direction.

Here too, a mounting plate is used with a rail that can be moved in the longitudinal direction of the plate, whilst it is held in place by the plate in all other directions.

Norwegian Patent 340839B1 teaches a system for optional dynamic positioning of a ski binding. An electric motor is shown, which is capable of driving a rail back and forth in the longitudinal direction.

Different user groups will require different solutions, and the most advanced users, e.g., in competitive sports, are willing to pay more to have the lightest and most functional equipment. For less advanced users who perhaps do not use the skiing equipment so frequently, it will often be of no importance whether the equipment weight a little more or has a little less functionality, as long as the user is able to have the same positive skiing experience.

However, it would be an advantage for the users to be able to upgrade their skiing equipment or replace components without having to purchase complete new pairs of skis if the user wishes to become a more active skier.

If the user, e.g., has skis with fixed bindings and would like a manual adjustment of the bindings in the longitudinal direction, it would be an advantage to be able to use the same binding, and only change the adjustment mechanism.

Another user perhaps already has manual adjustment, but would like to go one step further to electric adjustment. Again, it would be an advantage to be able to replace only the absolutely necessary parts.

In yet another example, it is possible to conceive of a user who already has an adjustment mechanism he is satisfied with, but wishes to change to another more advanced type of binding. Here, it would be an advantage to be able to change only the bindings.

In this way, users can, from the moment they purchase the skis with bindings, plan for a possible later upgrade. They can, e.g., choose to invest in good skis, but put off buying electric adjustment of the bindings until they see how the skis function.

This shows that users will have different needs, and also needs that will vary over time. There is therefore a need for a mounting plate and a mounting plate system comprising the mounting plate and some specific additional elements that meet these different needs.

At the same time, it is important that the parts that are reused by both the advanced and less advanced users, such as the mounting plate, both have the necessary strength and low weight that are required by the advanced users, and also are sufficiently inexpensive for the less advanced users.

However, there is no easy way of reusing the mounting plate, such that the same plate and thus the ski can be used for both fixed bindings and bindings that can be moved in the longitudinal direction, where the fixed binding requires a minimum of extra components in addition to the mounting plate, such that this solution can be kept simple and inexpensive.

BRIEF SUMMARY

The invention resides in a mounting plate and a mounting plate system as defined in the independent claims.

The mounting plate according to the invention permits use of the same mounting plate for different types of skiers and different types of binding systems. For fixed bindings, there will be no need for elements other than the mounting plate and a rail. Thus, the most basic solution can be made technically simple and inexpensive, whilst the mounting plate can be reused for more advanced solutions.

In addition to being adapted for different binding solutions, it is important that the mounting plate is extremely light, but at the same time robust, so that it can withstand the different loads to which it is subjected by different types of skiers with different binding combinations.

The mounting plate according to the invention therefore comprises in several different embodiments an interface with the ski, with the binding and with the displacement mechanism, which permits use of the same mounting plate in different configurations.

The invention comprises therefore several embodiments with different technical features, which, together, in different ways, contribute to synergistic effects that allow manufacture and use of such a useful mounting plate.

BRIEF DESCRIPTION OF THE DRAWINGS

FIG. 5*a* shows in addition a detail of the glue pocket (651).

FIG. 5*b* show in cross-section F-F the mounting plate (6) with the second rail (5*b*), i.e., a rail that can be moved in the longitudinal direction. FIG. 5*d* shows in cross-section I-I, which is at the same point on the mounting plate (6) as F-F, the mounting plate with the first rail (5*a*), i.e., the rail that cannot be moved in the longitudinal direction.

Figure 1:
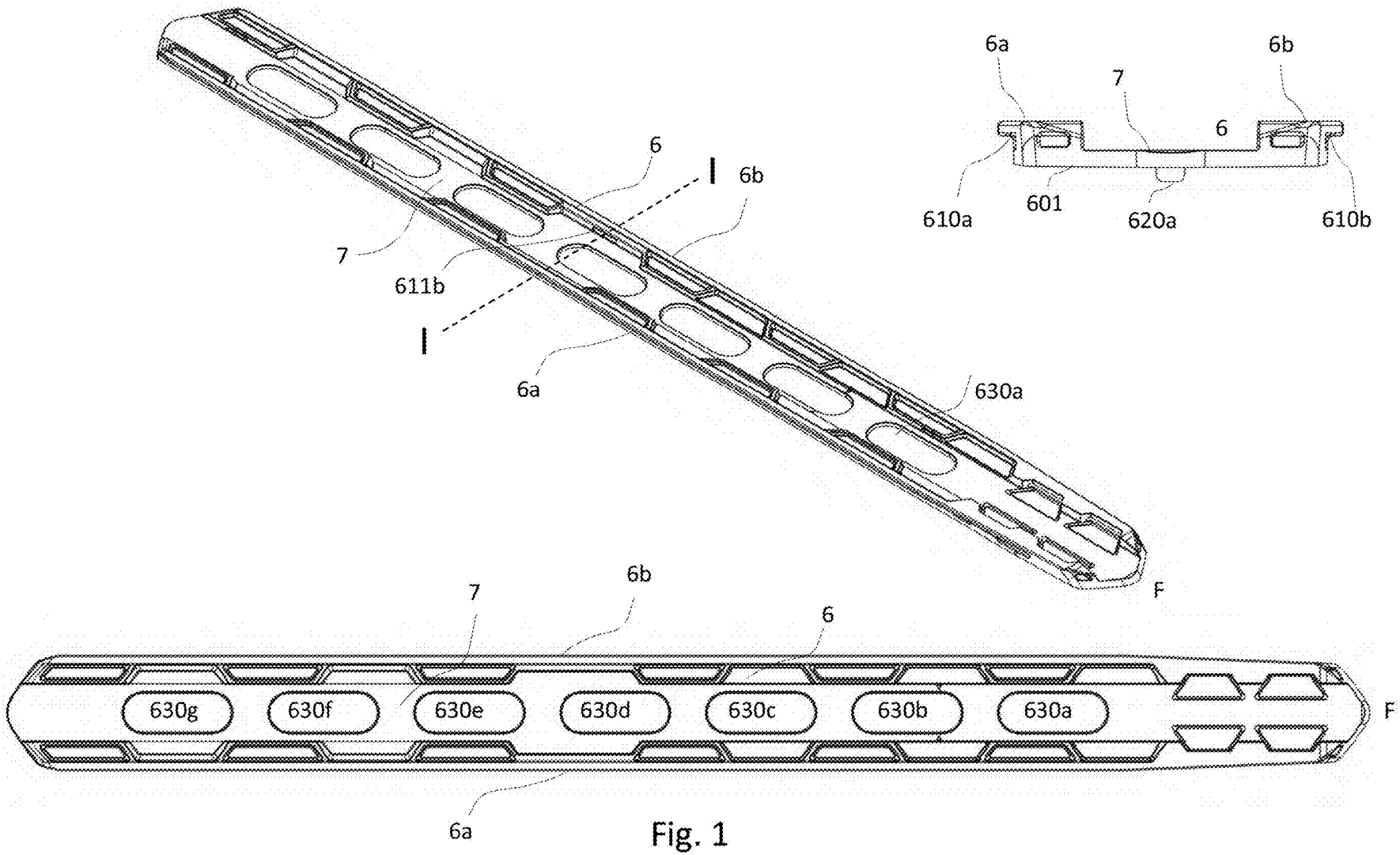
FIG. 1 shows a mounting plate (6) according to an embodiment of the invention, from above (at the bottom) in perspective and from in front (at the top right-hand side). F indicates the forward part of mounting plate.
Figure 2:
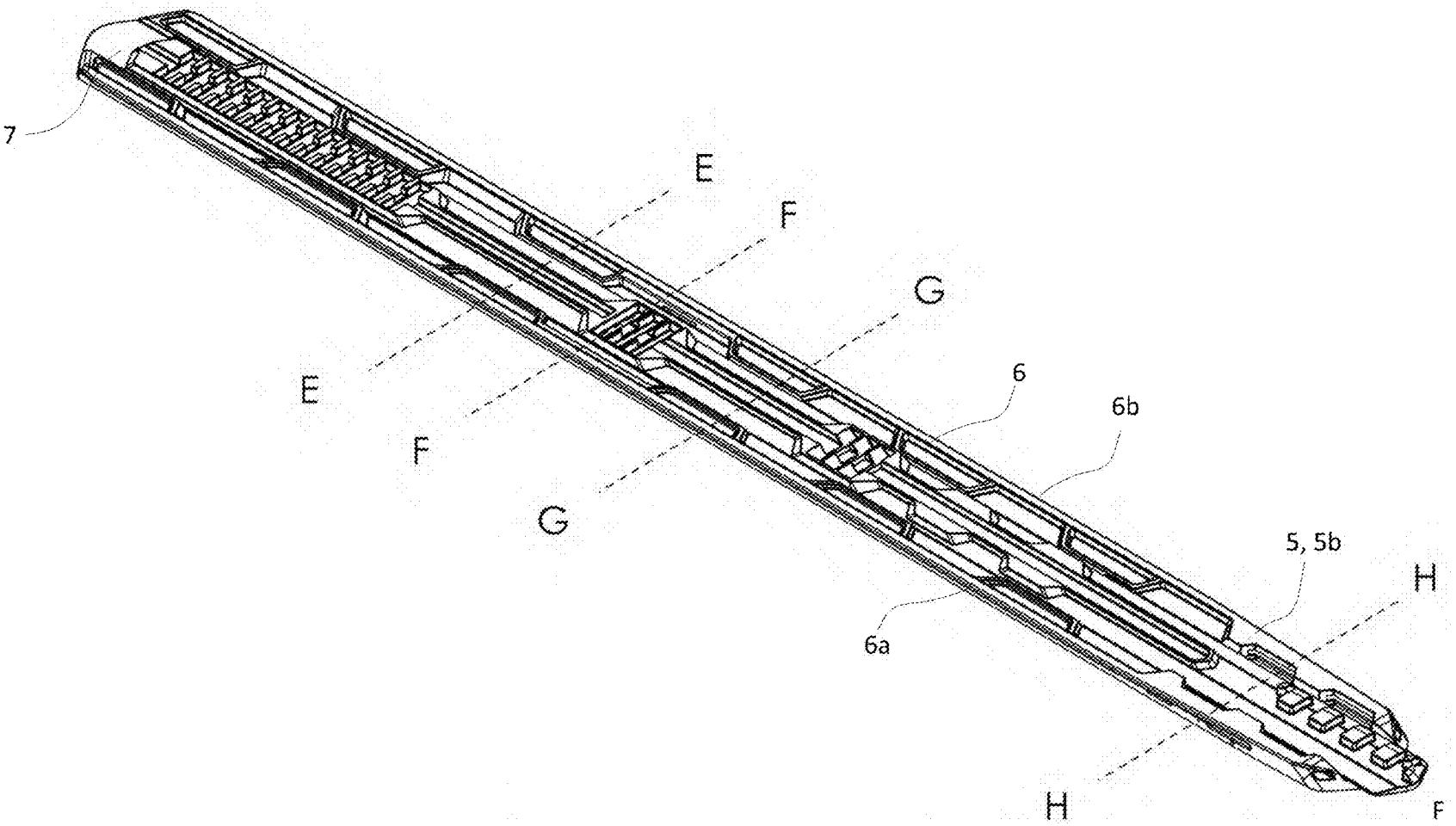
FIG. 2 shows the same mounting plate as in FIG. 1, but with a second rail (5*b*) that is movable in the longitudinal direction.
Figure 3:
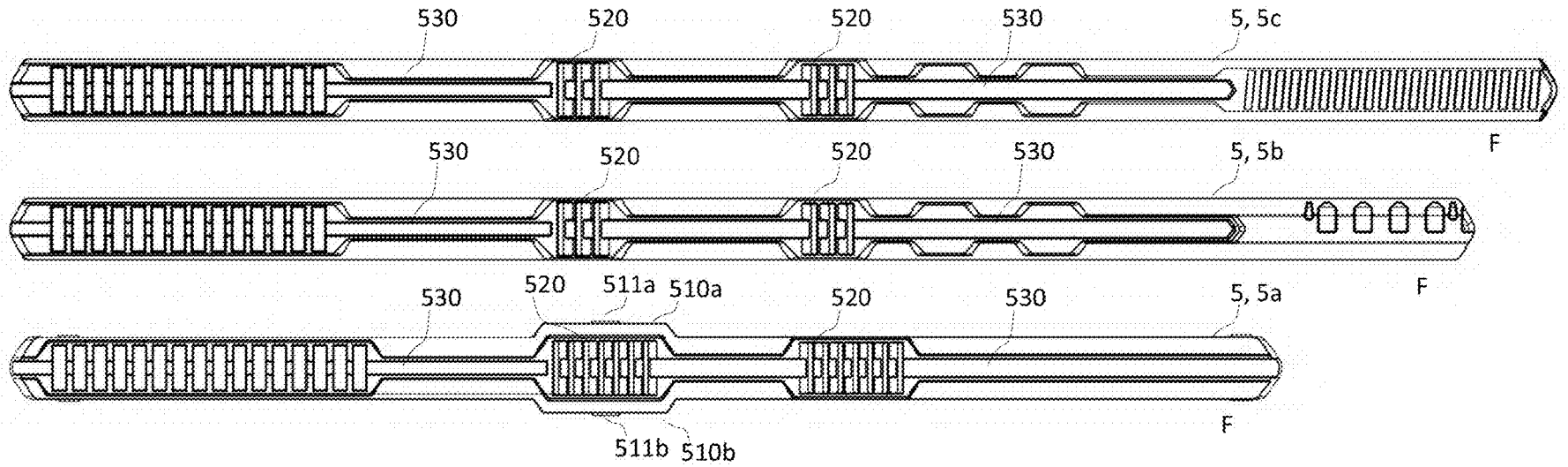
FIG. 3 shows examples of interchangeable rails that can be used in the mounting plate that was shown in FIG. 1 and FIG. 2. The first rail (5*a*) will be fixedly fastened to the mounting plate in the longitudinal direction. The second rails (5*b*, 5*c*) will be movable in the longitudinal direction. E.g., the second rail (5*b*) in the middle will be manually movable in that a manual mechanism acts on the projections on the front of the rail. The second rail (5*c*) at the top can be driven by an electric motor with an actuator that cooperates with the grooves on the front of the rail. Here, the uppermost and the midmost second rail (5*b*, 5*c*) have been given the same name, as they both are movable in the longitudinal direction.
Figure 4:
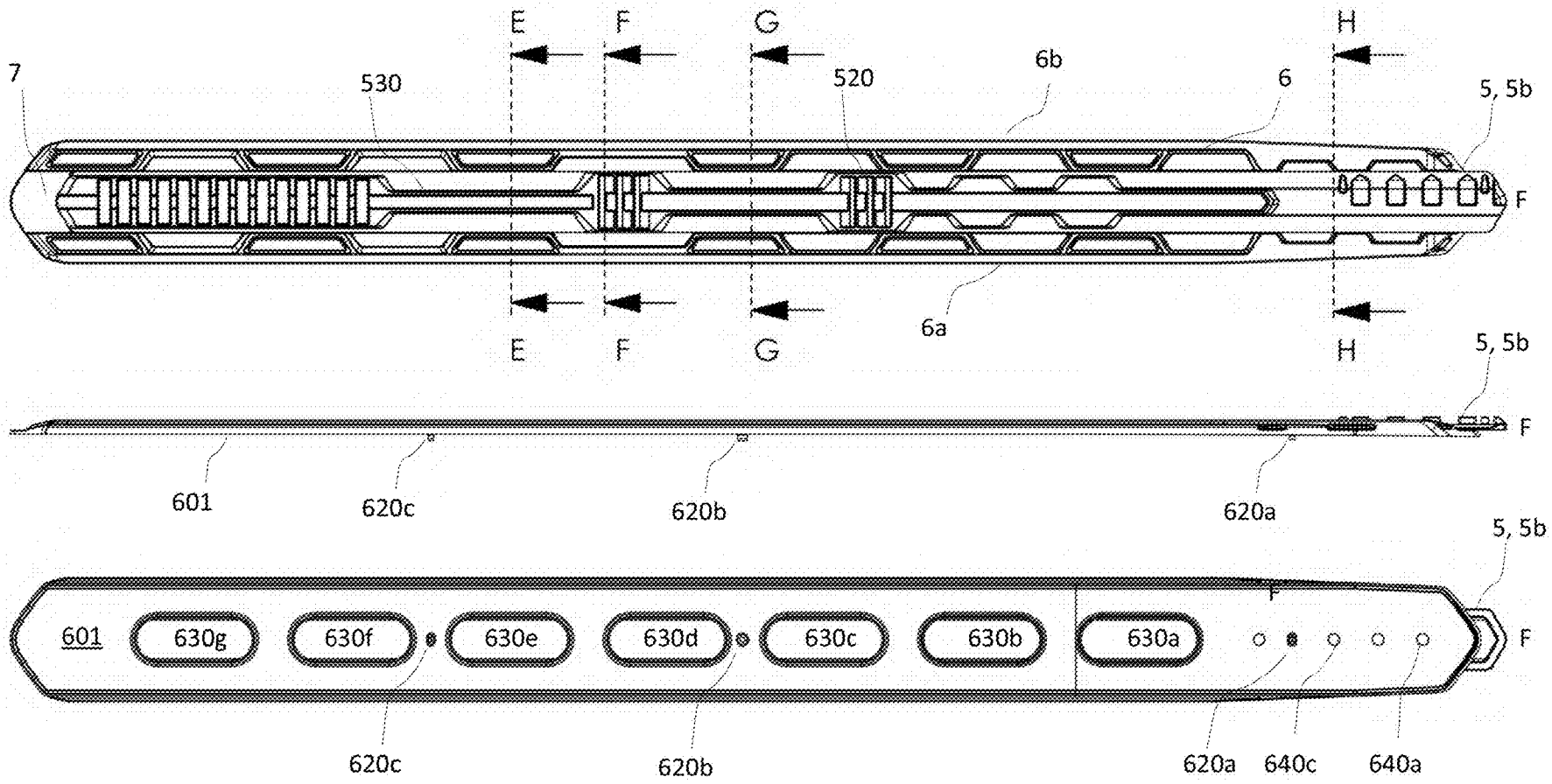
FIG. 4 shows the same mounting plate as in FIG. 2, but in a top view, a side view and a bottom view, respectively.
Figures 5A, 5B, 5C, 5D, 5E:
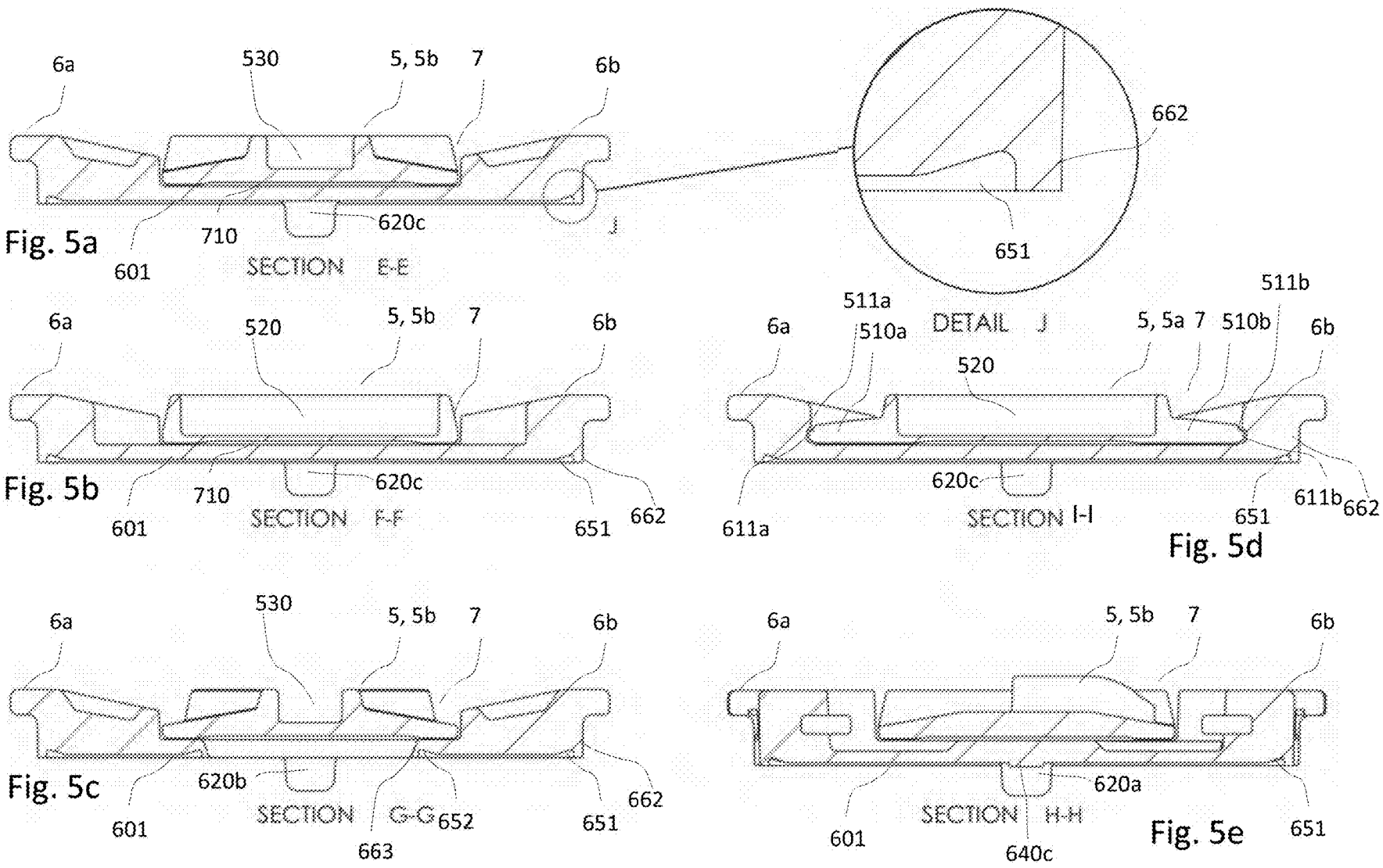
FIGS. 5*a*, 5*b*, 5*c*, 5*d* and 5*e* show different cross-sections of the mounting plate (6), where the cross-sections are defined in FIGS. 1, 2 and 4.

Cross-sections E-E and G-G in FIGS. 5*a* and 5*c* will be the same for both first and second rails (5*a*, 5*b*, 5*c*). The same will apply to many other cross-sections that will be understood by comparing the first and second rails (5*a*, 5*b* and 5*c*) in FIG. 3.

Figure 6:
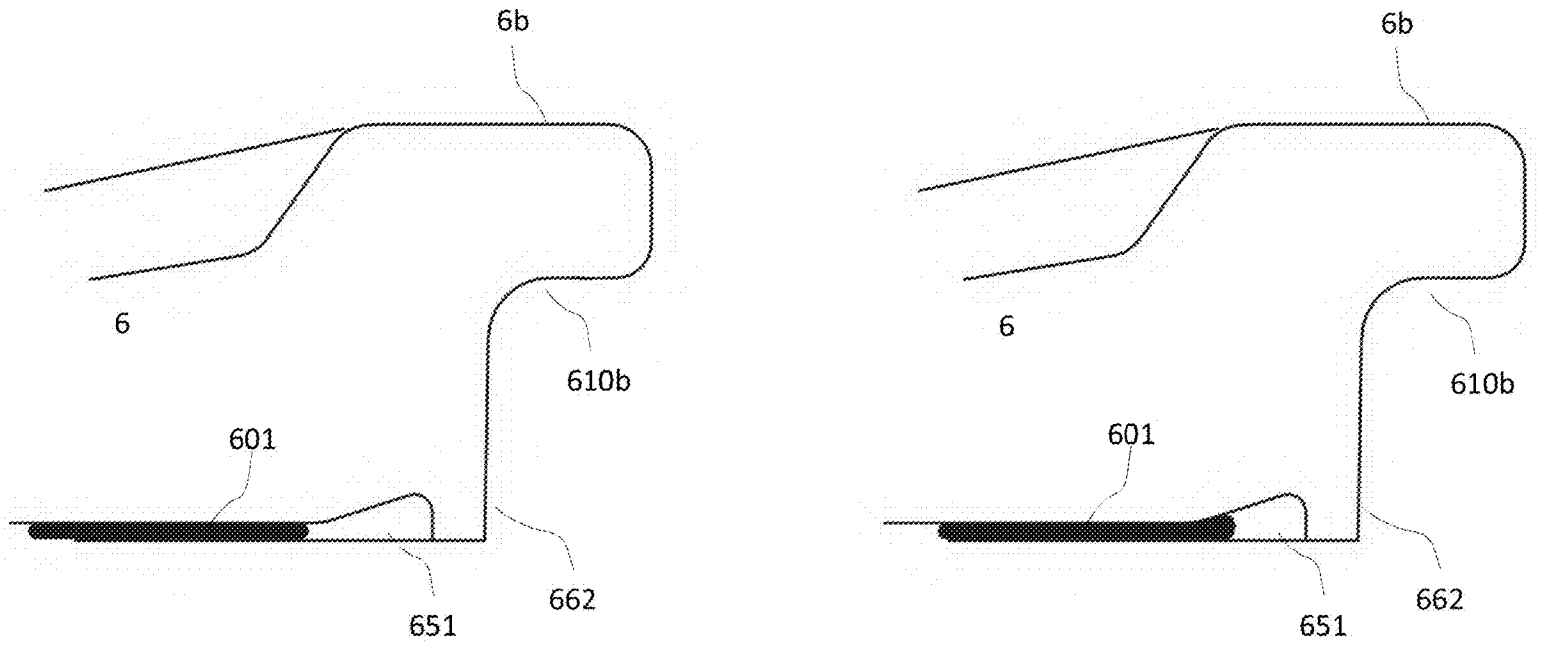

FIG. 6 shows in an embodiment a part of a cross-section of the mounting plate (6) with the first glue pocket (651). The thick black line shows the glue layer under the bottom surface (601), against the ski. To the left, a glue layer is shown that extends right up to the glue pocket (651), whilst in the figure to the right a little too much glue has been applied, which has been taken up by the glue pocket. Due to the configuration of the glue pocket, its capacity to take up glue increases more and more as the edges are approached, whilst the ceiling in the glue pocket in itself will help to ensure attachment far out towards the edge.

Figure 7:
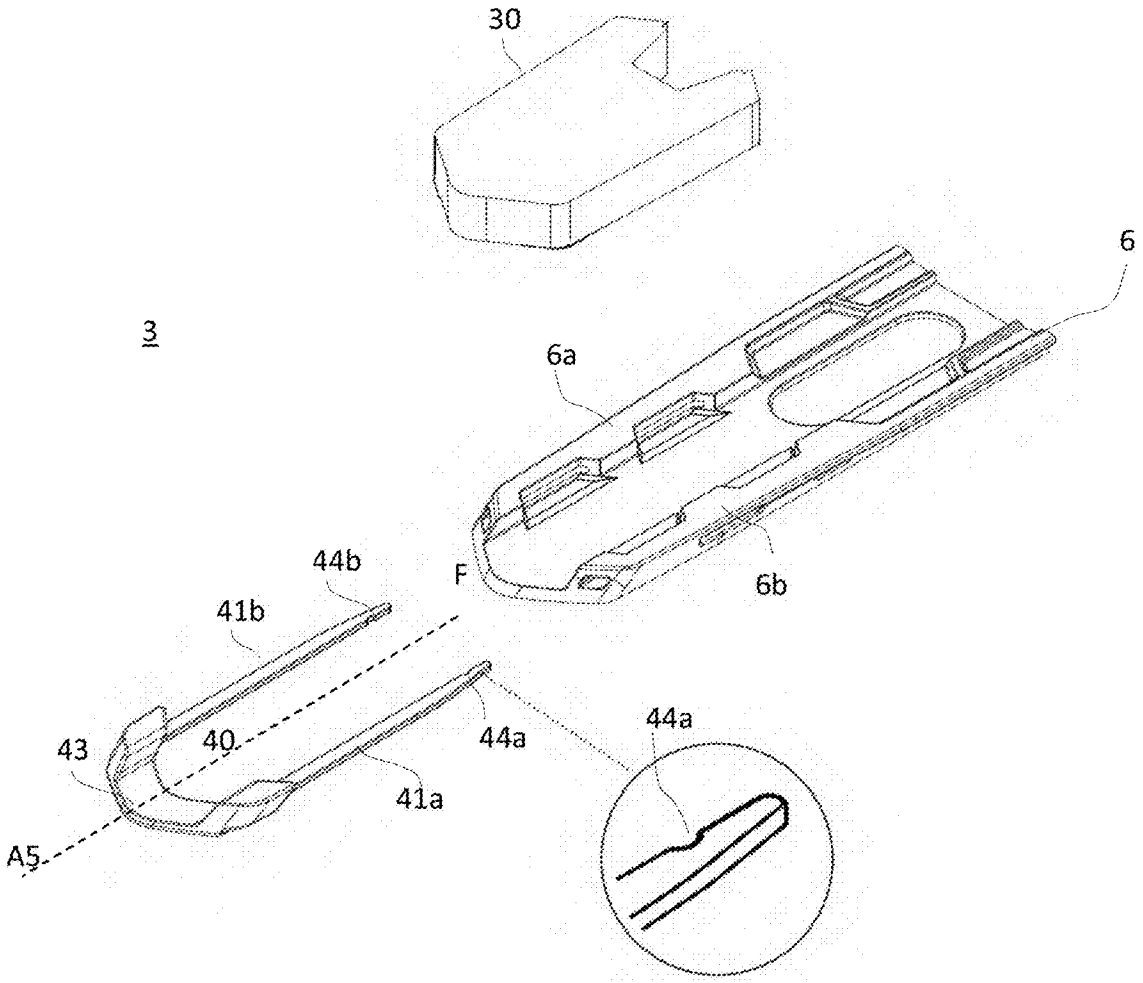

FIG. 7 shows a detachable element (30), which can be fastened to the mounting plate (6). Only the forward part of the mounting plate (6) is shown.

Figure 8:
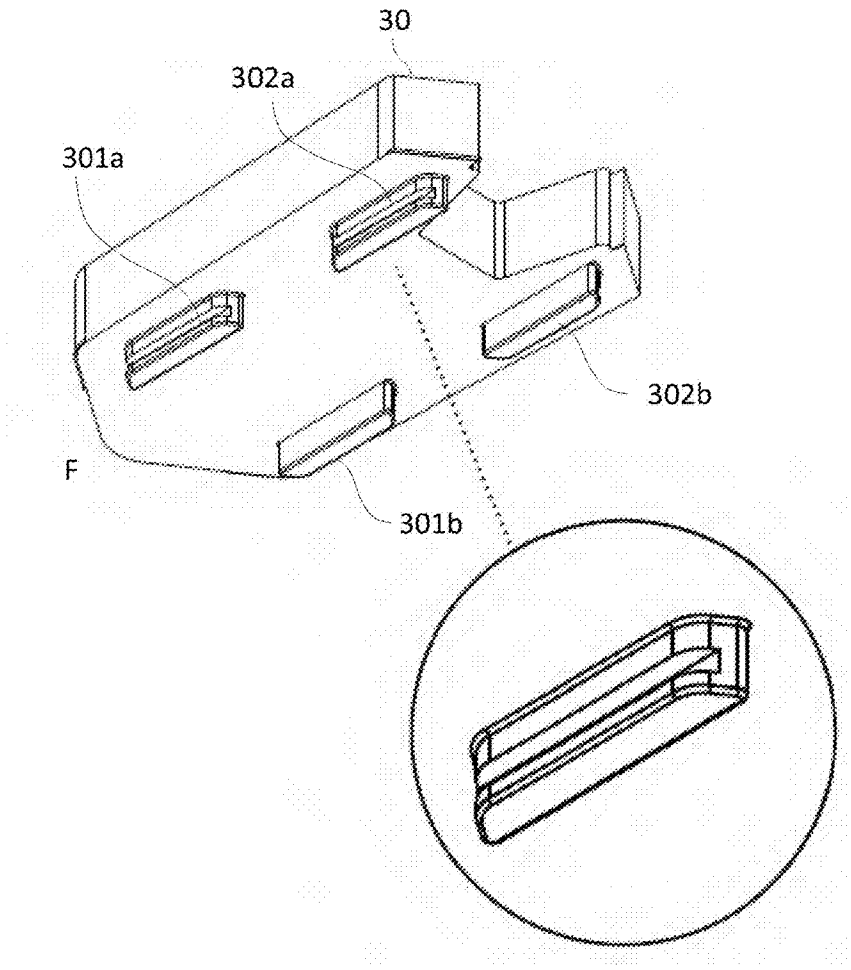
Figure 8:
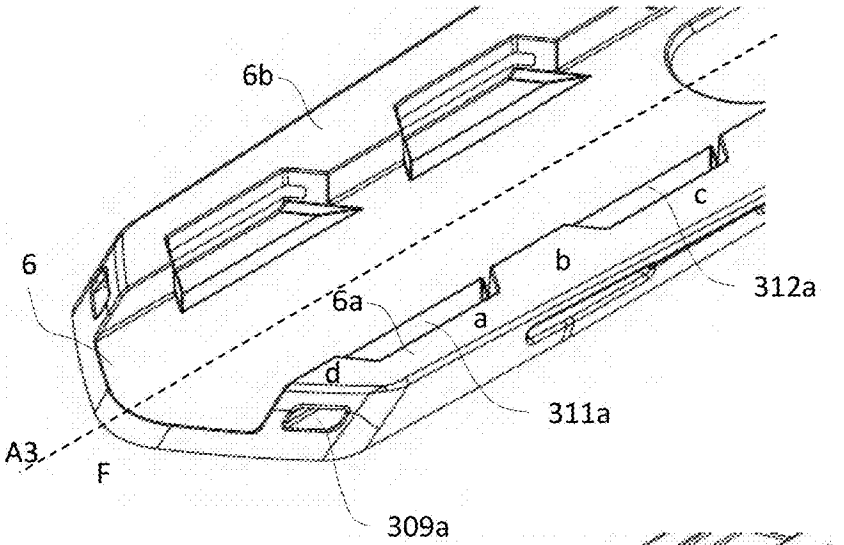
Figure 8:
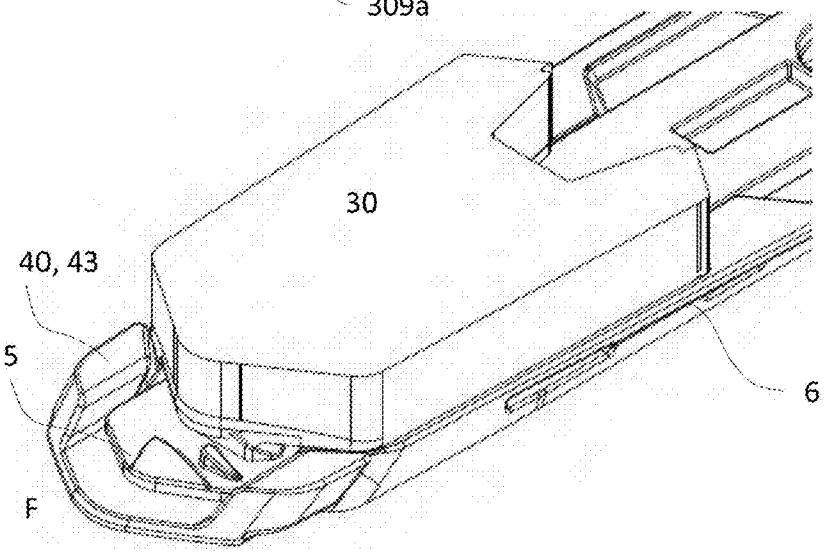

FIG. 8 shows, at the top right-hand side, an example of the forward part of a mounting plate (6), at the top right-hand side, an example of a fastening element (30) where one of the locking elements (302*a*) has been enlarged, and at the bottom left-hand side, the fastening element (30) placed down onto the mounting plate (6). Here, a second rail (5*b*) has also been included between the fastening element (30) and the mounting plate (6).

Figure 9:
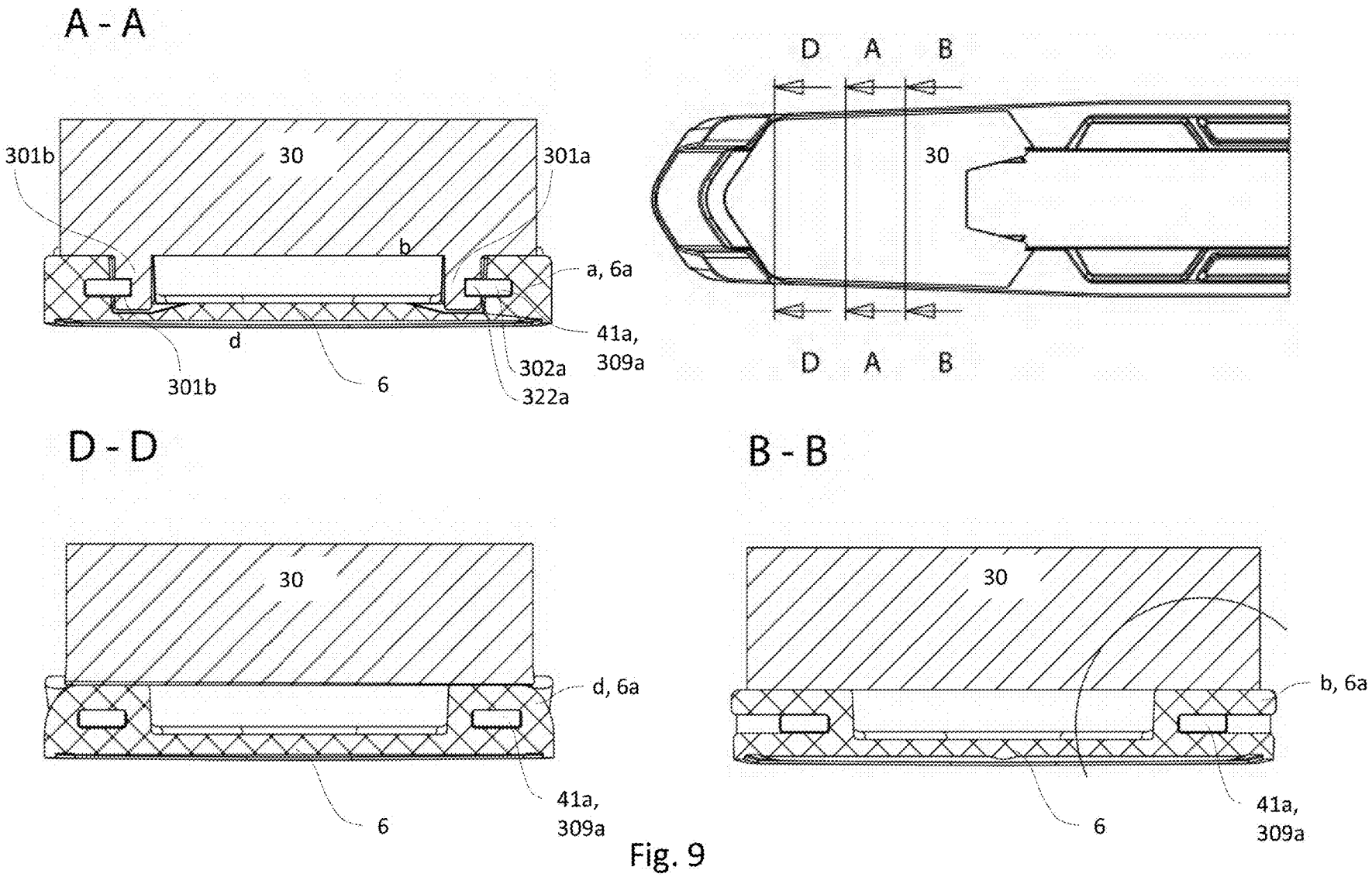

FIG. 9 shows three different cross-sections of the ski binding moving mechanism (1).

Figure 10:
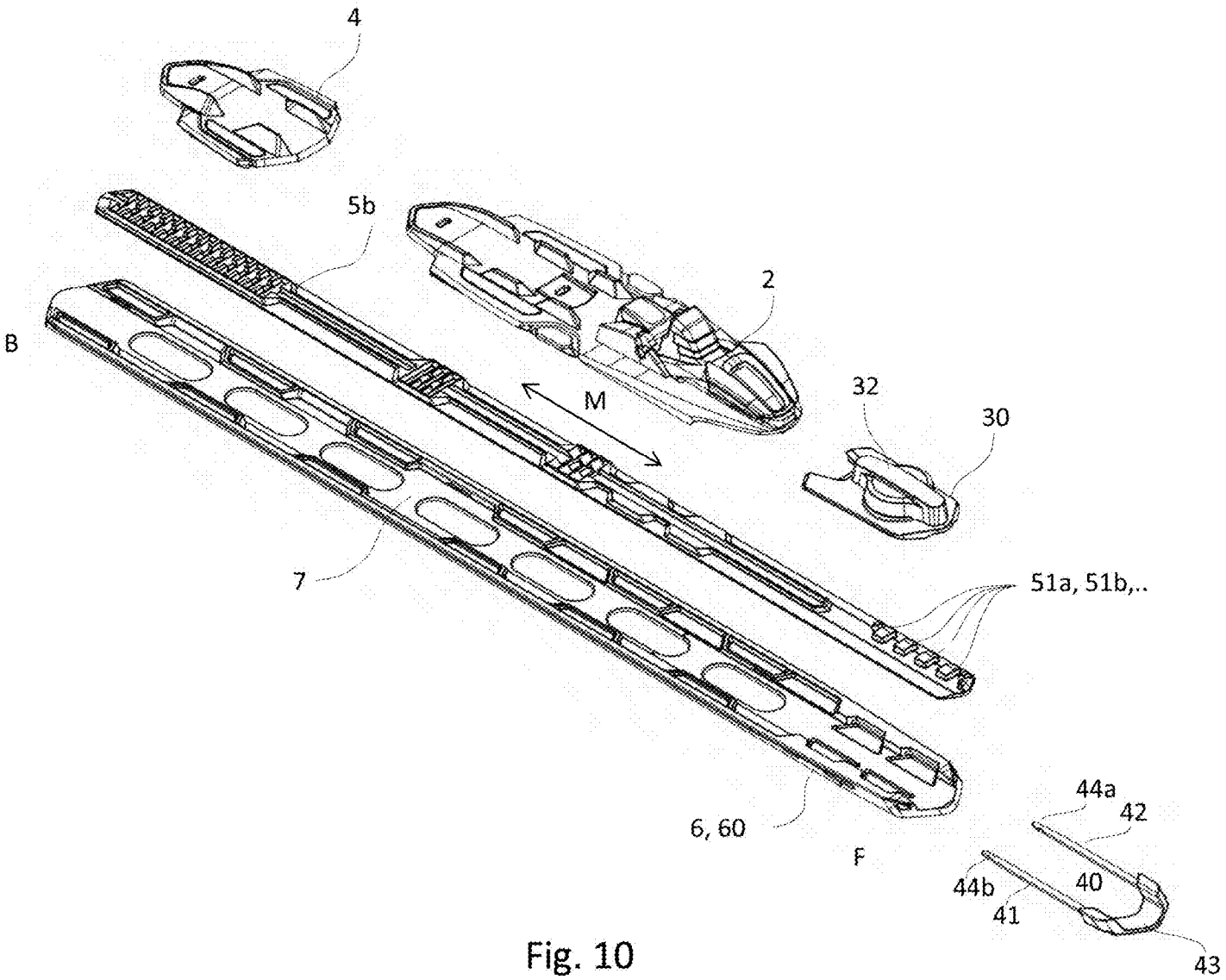

FIG. 10 shows an exploded view of a mounting plate (6) for a ski binding configured to be mounted on a ski, a second rail (5*b*) configured to be fastened to a ski binding (2, 2*a*), or to be part of a ski binding, a fastening element (30) and a vertical lock (40) which locks the fastening element (30) to the mounting plate (6).

Figure 11:
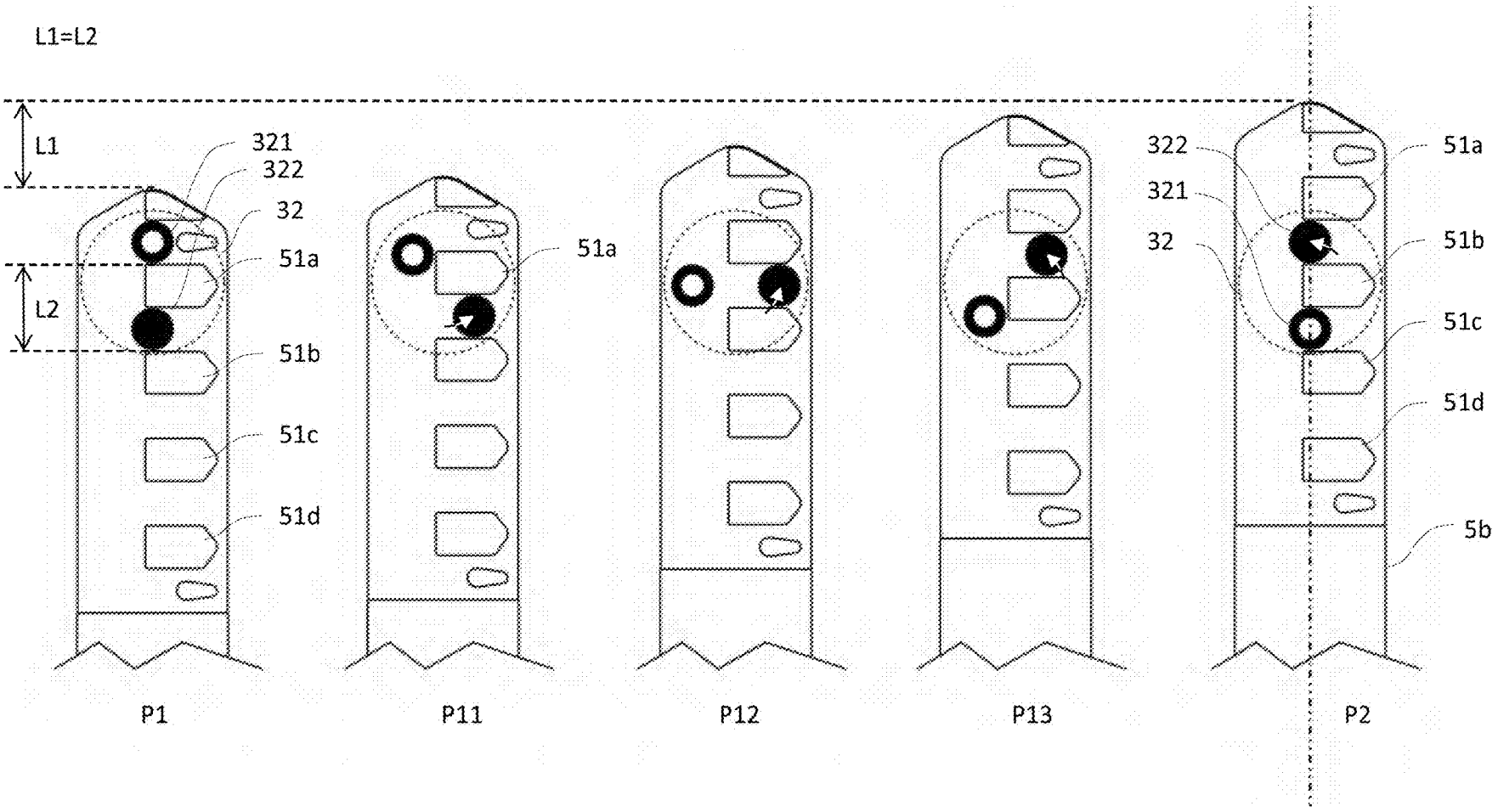

FIG. 11 illustrates the principle used to move the first rail (5*a*) forwards with the aid of the two rotating pins (321, 322).

EMBODIMENTS OF THE INVENTION

In the following section of the description, different examples and embodiments of the invention are shown to give the skilled artisan a more detailed understanding of the invention. The specific details that are associated with the different embodiments and with reference to the attached drawings should not be understood as limiting the invention. The scope of protection of the invention is defined by the accompanying patent claims.

The embodiments are numbered to give a good understanding of what is included in each one of them. In addition, a number of dependent embodiments are described, referred to as associated embodiments that are defined in relation to the numbered embodiment. Unless otherwise specified, an embodiment that is dependent on a numbered embodiment will be capable of being combined directly with the referred embodiment or any one of its associated embodiments.

An embodiment 1 of the mounting plate (1) according to the invention will now be explained with reference to FIGS. 1, 2, 3 and 4. In this embodiment, the mounting plate (6) comprises a bottom surface (601) configured to be laid against a ski. The ski is not shown.

The mounting plate (6) has an upward directed left and right side edge (6*a*, 6*b*) along the outer sides of the mounting plate, where the edges (6*a*, 6*b*) have laterally opposing undercuts (610*a*, 610*b*) that are configured to hold a ski binding (2*a*) with complementary cuts fastened to the mounting plate (6) in the vertical direction. Right and left side edges here are named in relation to a user's position on the ski, but what is right and left is not important in this connection.

The mounting plate (1) further comprises a longitudinal groove or channel (7).

In an associated embodiment, the channel (7) is configured to hold a first interchangeable rail (5, 5*a*) fixed in the lateral direction and the longitudinal direction and a second interchangeable rail (5, 5*b*, 5*c*), capable of being interchanged with the first rail (5*a*), fixed in the lateral direction but movable in the longitudinal direction.

Different types of rails can thus be placed in the channel (7), the mounting plate being configured to lock some of the rail types in the longitudinal direction, whilst others are not locked in the longitudinal direction. Thus, bindings that are mounted fixed on the mounting plate (6) are held in the vertical direction by the undercuts (610*a*, 610*b*) that engage with the complementary cuts in the binding, and are held in the longitudinal direction by the first rail (5*a*) that is locked in the longitudinal direction.

If a dynamic moving of the binding is desired, the first rail (5*a*) can be interchanged with a second rail (5, 5*b*, 5*c*) along which mounting plate (6) is configured to be moved in the longitudinal direction. The second rail (5, 5*b*, 5*c*) can, e.g., be guided in the longitudinal direction by an actuator coupled to the second rail (5, 5*b*, 5*c*).

In a second embodiment, which can be combined with embodiment 1, the groove (7) in a first cross-section (E-E) is narrower than in a second cross-section (I-I), where the groove (7) in the second cross-section is configured to arrest projecting wings (510*a*, 510*b*) on the first rail (5*a*), such that the first rail (5*a*) is held fixed in the longitudinal direction.

As the binding will lock the rail in the vertical direction, this will, together with a different width of the groove in the longitudinal direction, and corresponding wings on the first rail (5, 5*a*), mean that both the rail and the binding will be locked in all directions relative to the mounting plate (6) and the ski on which it is mounted.

In an associated embodiment, the groove (7) in the second cross-section (I-I) has an undercut (611*a*, 611*b*) on at least one side configured to receive a wing pin (511*a*, 511*b*) on one of the projecting wings (510*a*, 510*b*).

The wing pin (511*a*, 511*b*) can be inserted into the corresponding undercut in the mounting plate, and will hold the first rail (5, 5*a*) in place as long as the binding has not been mounted.

As a rule, holes are drilled or moulded in the ski in which the mounting plate pins are inserted, such that its position is fixed by the orientation of the pins in the holes. It is thus not necessary to assess or measure the position of the plate when it, e.g., is to be glued to the ski.

In an embodiment 3, which can be combined with any one of the embodiments above, the mounting plate (6) comprises first and second guide pins (620*a*, 620*b*) which extend down from the bottom surface (601) and are arranged to be inserted into two holes in the ski, the first and the second pin (620*a*, 620*b*) having a different extent in the longitudinal direction.

Giving the pins a different extent in the longitudinal direction, e.g., in that one or more of the pins have an elongate form in the lateral direction corresponding to the diameter of the holes, allows at least some of the length variation that arises when the ski's binding portion is depressed to be taken up in that the elongate pin is able to migrate slightly in the longitudinal direction of the hole.

In an associated embodiment, the mounting plate (6) has a third guide pin (620*c*) which extends down from the bottom surface (601) and is arranged to be inserted into a hole in the ski, where the middle one (620*b*) of the first, second and third guide pins (620*a*, 620*b*, 620*c*) has a greater extent in the longitudinal direction than the two other pins (620*a*, 620*c*).

The middle guide pin (620*b*) will thus be fixedly fastened to the longitudinal direction of the ski, whilst the two other pins (620*a*, 620*c*) will be able to migrate in the holes in the ski when the curvature of the ski changes as the ski is depressed.

In an embodiment 4, which can be combined with any one of the embodiments above, the height of the mounting plate (6) is greater at the forward part of the mounting plate (6) than at its central part.

In an associated embodiment, the height of the mounting plate (6) gradually increases towards the forward part of the mounting plate (6).

The rail will thus slide easily in the whole length of the groove, as the increase in thickness compensates for the curvature of the ski. By using an adjustment mechanism for the ski binding placed on the front of the plate, this effect will be even more obvious.

At the same time, the extra thickness in the tip will mean that the rail, which otherwise should be as thin and light as possible, obtains extra strength, such that the moving mechanism for the ski binding can be anchored in the area that has greatest strength. In addition to the actual improvement in the fastening of the moving mechanism, the forces from the moving mechanism are distributed evenly over a larger area of the mounting plate, such that it is securely fastened to the ski even when the fastening mechanism is subjected to large loads.

Even distribution of glue under the mounting plate (6) as far out to the edge as possible is one of several elements that are important to ensure that the binding does not pull the mounting plate off in the event of strong pull-off forces, especially upwards.

In an embodiment 5, which can be combined with any one of the embodiments above, the bottom surface (601) is configured to be glued to a ski, wherein one side edge of the mounting plate (6) in a cross-section of the mounting plate (6) forms a first wall (662*a*), where mounting plate (6) comprises a first glue pocket (651) between the bottom surface (601) and the first wall (662*a*), and where the glue pocket (651) in a cross-section has a gradually increasing area from the bottom surface (601) towards the first wall (662*a*).

In an associated embodiment, the first glue pocket (651) has a gradually increasing height from the bottom surface towards the first wall (662).

In a second associated embodiment, the first wall (662) extends below the bottom surface (601) such that there is space for a glue layer between the bottom surface (601) and the ski.

The glue pocket according to the invention means that the amount of glue used is less critical and that it is possible on the one hand to obtain full glue cover under the whole of the bottom surface, and on the other hand prevent spillage on the ski outside the binding. The glue pocket with its characteristic configuration will, to start with, only take up a little of the excess glue, but gradually take up more and more, as the height increases with the distance. Thus, the glue surface can be maximised, resulting in a reduction of the moment that arises when the edge of the mounting plate is pulled up by the binding.

In an embodiment 6, which can be combined with any one of the embodiments above, the mounting plate (6) comprises in a cross-section one or more through holes or grooves (630*a*, 630*b*, . . . ) in the central area of the mounting plate.

This results in the weight of the plate being capable of being reduced without reducing the strength of the plate significantly when it is in use. With glued plates and a binding that is fastened on the side, it is less important to have glue in the middle, as the pull-off forces have their point of action on the outer edges of the mounting plate.

In an associated embodiment, the circumference of the hole has a second wall (663), where the mounting plate (6)

comprises a second glue pocket (652) between the bottom surface (601) and the second wall (663), where the second glue pocket (652) in a cross-section has a gradually increasing area from the bottom surface (601) towards the second wall (663).

Like the first glue pocket (651), the second glue pocket (652) can also, in an associated embodiment, have a gradually increasing height from the bottom surface towards the second wall (663).

In a second associated embodiment, the second wall (663) extends below the bottom surface (601) such that there is space for a glue layer between the bottom surface (601) and the ski.

In an embodiment 7, the mounting surface (601) comprises one or more spacer pins (640*a*, 640*b*, 640*c*) that extend down to the same level as the side edges of the mounting plate and are configured to butt against the surface of the ski.

In some areas of the mounting plate (6) there may be a need to control pull-off forces with a point of action more towards the centre of the mounting plate, such as, e.g., in front or behind, if, e.g., an actuator is provided which is to be used to move the rail in the mounting plate. In this area there will usually not be any through holes. The spacer pins (640*a*, 640*b*, 640*c*) prevent the mounting plate from collapsing against the ski in this area during mounting, whilst allowing it to be kept very thin and light.

The longitudinal groove prevents play between the binding and the plate. Lateral forces taken up by the rail in this way will be converted into diagonal, downward forces against the glue surface instead of lateral forces with a certain lever arm if the forces are to be taken up by the mounting plate edges.

An embodiment 8 of the mounting plate (3) according to the invention will now be explained with reference to FIG. 7. In this embodiment, the mounting plate (3) is configured to hold a changeable fastening element (30).

Furthermore, with reference to FIG. 8, which shows additional details, the mounting plate (6) and the fastening element (30) comprise respectively one or more first locking elements (301*a*, 302*a*) and one or more second locking elements (311*a*, 312*a*), the first locking elements (301*a*, 302*a*) and the second locking elements (311*a*, 312*a*) engaging with one another and locking the fastening element (30) in the longitudinal and lateral direction of the mounting plate (6) when the fastening element (30) is arranged from above and down on the mounting plate (6).

In an associated embodiment which can be combined with embodiment 1, the first locking elements (301*a*, 302*a*) are projecting elements which extend out from respectively the fastening element (30) and the second locking elements (311*a*, 312*a*) are opposing constrictions or apertures in the mounting plate (60).

In an embodiment 9, which can be combined with embodiment 8, the mounting plate (3) is configured to receive and hold a vertical lock (40) adapted to lock the first and the second locking elements (301*a*, 302*a*, 311*a*, 312*a*) to one another in the vertical direction.

In an embodiment 10, which can be combined with embodiment 9 or 10, the vertical lock (40) comprises at least one pin (41*a*) configured to be mounted in the longitudinal direction of the mounting plate (6). This is illustrated in FIG. 7.

In a first associated embodiment, which can be combined with embodiment 3 above, the first edge (6*a*) has varying width such that a second area (a) of the first edge (6*a*) forms the second locking element (311*a*), the edge (6*a*) comprising at least one first area (d) adjacent to the second area (a), where the first area (d) is wider than the second area (a), and where the first area (d) has a longitudinal channel (309*a*) configured to receive the vertical lock (40).

In a second associated embodiment, which can be combined with the first associated embodiment above, both the second area (a) and the first locking element (301*a*) have adjacent longitudinal grooves (322*a*, 302*a*) in their side walls configured to form, together, an extension of the longitudinal channel (309*a*) when the fastening element (30) is arranged on the mounting plate (6).

In an embodiment 11, which can be combined with any one of the embodiments above, the fastening element (30) comprises two or more first locking elements (301*a*, 301*b*) arranged one after another in the longitudinal direction.

In a first associated embodiment, the edge (6*a*) comprises at least a third area (b) adjacent to the second area (a), where the third area (b) is wider than the second area (a), and where the longitudinal channel (309*a*) continues into the third area (b).

In a second associated embodiment, which can be combined with the embodiment above, it comprises at least a fourth area (c) arranged directly after the third area (b) in the longitudinal direction, where the two first locking elements (301*a*, 302*a*) are configured to fit into respectively the second and the fourth area (a, c), such that the longitudinal channel (309*a*) extends from the first area (d) into the fourth area (c) and where the channel alternates between being a longitudinal hole in the first edge (6*a*) of the mounting plate and a channel that is formed of longitudinal grooves (322*a*, 302*a*, 323*a*, 303*a*) in the side walls of the two first locking elements (301*a*, 302*a*) when the fastening element (30) is arranged on the mounting plate (6).

In a third associated embodiment, which can be combined with the second associated embodiment above, the edge (6*a*) comprises at least a fifth area (e) arranged directly after the fourth area (c) in the longitudinal direction, where the fifth area (e) is wider than the fourth area (c), and where the longitudinal channel (309*a*) continues into the fifth area (c).

In an embodiment 12, which can be combined with embodiment 10 or 11, the longitudinal channel (309*a*) and the pin (41*a*) have in a cross-section one or more straight surfaces.

In an associated embodiment, it has a rectangular cross-section. One or more of the surfaces in cross-section can be horizontal.

In an embodiment 13, which can be combined with any one of embodiments 10 to 11, the mounting plate (3) comprises a lock (44*a*, 45*a*) configured to lock the pin (41*a*) in the longitudinal direction when the vertical lock (40) locks the fastening element (30) in the vertical direction.

In an associated embodiment, which can be combined with the embodiment above, the pin (41*a*) comprises notches (44*a*) or juts that are configured to engage with opposing juts (45*a*) or notches in the fastening element (30) or mounting plate (6).

An example of notches (44A) in the pin (41*a*) is shown in FIG. 7. An opposing jut (45*a*) is illustrated in FIG. 10, on the bottom right-hand side. However, this could also be vice versa, such that the notch is in the fastening element and the jut on the pin (41*a*).

In an embodiment 13, which can be combined with any one of the embodiments above, or any one of their associated embodiments, the mounting plate (60) is symmetrical about a third longitudinal axis (A3), such that it comprises a second upward directed edge (6*b*) on the opposite side to the first edge (6*a*).

In an embodiment 14, which can be combined with any one of the embodiments above, or any one of their associated embodiments, the fastening element is symmetrical about a fourth longitudinal axis (A4), such that it comprises one or more first fastening elements (301*a*, 301*b*) on each side.

In an embodiment 15, which can be combined with any one of the embodiments above or any one of their associated embodiments, the vertical lock (40) is symmetrical about a fifth longitudinal axis (A5), such that it comprises a longitudinal pin on each side (41*a*, 41*b*), as shown in FIG. 7.

In embodiments 7, 8 and 9 which relate to symmetry, what is meant is that all elements that are mentioned in the referred embodiments will be symmetrical about the axes of symmetry, as is illustrated in FIGS. 7 to 10.

In a first associated embodiment, which can be combined with embodiment 15 above, the vertical lock (40) comprises a mounting bracket (43) that holds the two pins (41*a*, 41*b*), and where the vertical lock (40) is configured to be locked and opened relative to the mounting plate (6) and the fastening element (30) on the application of a longitudinal force on the mounting bracket (43) in respectively first and second opposite longitudinal directions.

In a second associated embodiment, which can be combined with the first associated embodiment above, the vertical lock (40) has a spring force in a lateral direction such that the juts (45*a*, 45*b*) are pressed into the notches (44*a*, 44*b*) by the spring force when the vertical lock (40) is in a locking position and out of the notches (44*a*, 44*b*) when the vertical lock (40) is not in the locking position.

In an embodiment 16, the invention is a mounting plate system which comprises the mounting plate (6) according to any one of the embodiments above and a rail (5) configured to fit into the channel (7).

In an associated embodiment, the rail (5) is one of the first or second interchangeable rails (5*a*, 5*b*, 5*c*).

In an embodiment 17 which can be combined with embodiment 16, the rail (5) has in a cross-section (E-E, I-I) an undercut (710).

The rail will thus not so easily remain lodged in the mounting plate, which makes it easier to change. In the event that the second interchangeable rail or rails (5*b*, 5*c*) are used, the undercut will also help to ensure that the rail slides smoothly in the longitudinal direction in relation to the mounting plate (6).

In an embodiment 18, which can be combined with any one of the embodiments for the mounting plate system above, the rail (5) comprises a binding attachment mechanism (520) configured to lock the ski binding (2*a*) to the rail (5) in the longitudinal direction.

In a first associated embodiment, the binding attachment mechanism (520) is configured to lock the ski binding (2*a*) fixedly to the rail (5) in several possible positions in the longitudinal direction.

In a second associated embodiment, the rail (5) has one or more holes or grooves to receive a pin, a screw or other fastening element configured to lock the binding to the rail (5).

In a third associated embodiment, the rail (5) has one or more pins or cams configured to fit into complementary holes or grooves in the bottom edge of the binding.

In a fourth associated embodiment, the mounting plate system comprises an adapter with one or more pins, screws or the like configured to fit into the holes or grooves in the rail, and also locking means configured to lock the binding in the longitudinal direction in relation to the adapter.

The adapter can, e.g., be used to move the binding in relation to the balance point of the ski if the user is not satisfied with the original placement, or to be able to use different types of alternative ski bindings on the same mounting plate. This requires that the binding should be adapted to the undercuts (610*a*, 610*b*).

In an embodiment 19, which can be combined with any one of the embodiments for the mounting plate system above, the rail (5) comprises a heel plate attachment mechanism (540) configured to lock a heel plate (2*a*) to the rail (5) in the longitudinal direction.

The heel plate can thus be locked relative to the mounting plate, both when the rail is fixed in the longitudinal direction and where the rail is movable in the longitudinal direction, such that the heel plate always follows the binding.

In an embodiment 20, which can be combined with any one of the embodiments for the mounting plate system above, the rail (5) has one or more notches (530) or longitudinal grooves configured to receive one ore more complementary pins in a binding (2*a*), where the notches (530) or grooves in the rail are configured to take up forces in the lateral direction from the binding (2*a*) via the pins, where the rail (5) further is configured to transfer the forces to the mounting plate (6).

In an embodiment, which can be combined with any one of the embodiments for the mounting plate system above, the mounting plate system comprises a second rail (5*b*, 5*c*) disposed, at least partly, between the fastening element (30) and the mounting plate (6), where the fastening element (30) is configured to lock the rail (5) in the longitudinal direction.

In an embodiment 22, which can be combined with any one of the embodiments above, the fastening element (30) comprises a rotatable element (32), rotatably attached to the fastening element (30), and a first and second rotating pin (321, 322) arranged to rotate with the rotatable element (32), where the rotatable element (32) is configured to be rotated at least one revolution and push the second rail (5*b*) in the same longitudinal direction throughout the revolution. This is illustrated in FIG. 10

In a first associated embodiment, which can be combined with the embodiment above, the rotatable element (32) is configured to be rotated at least one and a half revolutions and move the second rail (5*b*) in the same longitudinal direction throughout the revolutions.

The longitudinal movement of the second rail (5*b*) is indicated by the arrow M in FIG. 10. By "the same longitudinal direction" is meant therefore forwards in the mounting plate or backwards in the mounting plate.

The ski binding shown here is an NNN toe binding suitable for cross-country skiing, but the invention can be used to move any type of binding providing the rail and the binding are complementary, i.e., are made to be fastened together. Thus, other binding types used in other skiing disciplines can also benefit from the advantages of the invention in cases where it is desirable to have a binding that can be moved in the longitudinal direction, e.g., telemark, randonnée etc.

In a second associated embodiment, which can be combined with the first associated embodiment above, the second rail (5*b*) comprises:

two or more sliding elements (51*a*, 51*b*, . . . ) arranged one after another and configured to cooperate with the rotating pins (321, 322), where the first and the second rotating pin (321, 322) are configured to alternately push the sliding elements (51*a*, 51*b*, . . . ), and thus the rail (5), in the same longitudinal direction when the rotatable element (32) is rotated.

In a third associated embodiment that is explained with reference to FIG. 11, an example is shown of how the first and the second rotating pin (321, 322) cooperate with the sliding elements (51*a*, 51*b*, . . . ), such that the rail can be pushed in the longitudinal direction. A moving mechanism with five positions (P1-P5) is illustrated in this figure.

As described above, the first and the second rotating pin (321, 322) are configured to rotate with the rotatable element (32), which is indicated as a broken circle in this case, such that the pins (321 and 322) will be visible. However, the rotatable element (32) may have other types of shapes without this being of consequence for the invention. The pins are indicated by a solid circle and an open circle merely to show their relative position in the sequence that is to be described.

In the first position (P1), the rail (5*b*), and thus a ski binding (2, 4) on the rail (5), are in the rearmost position in relation to the mounting rail and the ski. These are not shown in the figure, but for illustration of the further positions in the sequence, it is important to understand that the rotatable element (32) is fixed relative to the longitudinal direction of the mounting plate (6) and the ski.

The first pin (321) here is in front of the first sliding element (51*a*), whilst the second pin (322) is between the first and the second sliding element (51*a*, 51*b*).

In the next position (P11), the rotatable element (32) has been rotated anticlockwise about 45 degrees, and the rail (5*b*) has been pushed a short distance forward because the second pin (322) has moved forward and to the right as a result of the rotary movement, as illustrated by the black and white arrow. Due to the forward movement of the second pin (322) whilst it abuts against the rear of the first sliding element (51*a*), it thus forces the second rail (5*b*) forward.

In the subsequent position (P12), this becomes even clearer. Here, the rotatable element (32) has been rotated anticlockwise about 90 degrees, and the second rail (5*b*) has been pushed a little distance further forward because the second pin (322) has moved even further forward and to the right as a result of the rotary movement.

In the next position (P13), the rotatable element (32) has been rotated anticlockwise about 135 degrees, and the second rail (5*b*) has been pushed a little further forward. Now, however, the second pin (322) has moved forward and to the left since the last position (P12).

In position 2 (P2), the rotatable element (32) has been rotated anticlockwise about 180 degrees, and the second rail (5*b*) has been pushed a little further forward. The second pin (322) has moved forward and to the left since the last position (P13), and has continued to push the first sliding element (51*a*) and the second rail (5) forward.

In position 2 (P2), the second pin (322) is still located between the first and the second sliding element (51*a*, 51*b*), whilst the first pin (321) which to begin with was in front of the second pin (322), is now behind the second pin (322), more specifically between the second and the third sliding element (51*b*, 51*c*).

Another way of explaining how the second rail (5*b*) is pushed forwards is to look at it as though the pins (321, 322) climb backwards on the sliding elements (51*a*, 51*b*, . . . ) when the rotatable element (32) is rotatable anticlockwise. As the rotatable element (32) is fixed in the ski, the second rail (5*b*) must be pushed forward. The rail is during the half revolution pushed forward a length L1, as shown in the figure.

In position 2 (P2), as previously mentioned, the rotatable element is rotated about 180 degrees, or a half revolution. However, it is possible to continue the rotary movement if it is desirable to push the rail (5) and the binding (2) even further forward.

Although it is not illustrated in FIG. 11, the skilled artisan will understand that a continued rotation of the rotatable element (32) anticlockwise in FIG. 11, starting from position 2 (P2) will result in the first pin (321) now beginning to push on the rear of the second sliding element (51*b*) in the same way as the second pin (322) in the previous half revolution pushed on the rear of the first sliding element (51*a*). During the next half revolution in the same direction, the rail (5) will thus be pushed forwards a further length L1, to a position 3, not shown in FIG. 11, where the second pin (322) is now located between the third and the fourth sliding element (51*c*, 51*d*).

In position 3 it will still be possible to rotate the rotatable element (32) anticlockwise. After another half revolution, the rail (5) is in a position 4, not shown in FIG. 11, where the first pin (321) is behind the fourth sliding element (51*d*).

In an embodiment 23, which can be combined with any one of the embodiments for the mounting plate system above, the fastening element (30) comprises an electric motor fixedly arranged relative to the fastening element (30), where the electric motor is configured to drive the rail (5, 5*c*) in the longitudinal direction, forwards and backwards.

In an associated embodiment, which can be combined with the embodiment above, the mounting plate (3) comprises a drive mechanism between the electric motor and the rail (5) which comprises one or more of the groups comprising: a gearwheel, a wire, a chain, a toothed rack, a worm screw, a worm drive, a piston.

In an embodiment 24, which can be combined with any one of the embodiments for the mounting plate system above, the rail (5) is a part of a ski binding.

In an embodiment 25, which can be combined with any one of embodiments 16-23 for the mounting plate system, the rail (5) has an attachment for a ski binding.

In an embodiment 26, which can be combined with any one of embodiments 16-25 above, the mounting plate system comprises one or more of the fastening element (30) and the vertical lock (40).

The invention claimed is:

1. A mounting plate for a ski, comprising:

a bottom surface configured to be placed against a ski;

upward directed left and right side edges along the outer sides of the mounting plate, where the edges have laterally opposed undercuts that are configured to hold a ski binding with complementary cuts fastened to the mounting plate in the vertical direction;

a longitudinal groove, configured to hold a first interchangeable rail in the lateral direction and the longitudinal direction, and a second interchangeable rail that can be interchanged with the first rail, fixed in the lateral direction but movable in the longitudinal direction.

2. The mounting plate according to claim 1, where the groove in a first cross-section is narrower than in a second cross-section, where the groove in the second cross-section is configured to arrest projecting wings on the first rail, such that the first rail is fixedly held in the longitudinal direction.

3. The mounting plate according to claim 2, where the groove in the second cross-section has an undercut on at least one side configured to receive a wing pin on one of the projecting wings.

4. The mounting plate according to claim 1 comprising a first and second guide pin which extend downwards from the bottom surface and are arranged to be inserted into two holes in the ski, where the first and the second pin have different extents in the longitudinal direction.

5. The mounting plate according to claim 4 which comprises a third guide pin which extends downwards from the bottom surface and is arranged to be inserted into a hole in the ski, where the middle one of the first, second and third guide pins has a larger extent in the longitudinal direction than the two other pins.

6. The mounting plate according to claim 1, where the height of the mounting plate is greater at the forward part of the mounting plate than at its central part.

7. The mounting plate according to claim 6, where the height of the mounting plate is gradually increasing towards the forward part.

8. The mounting plate according to claim 1, where the groove is through going in the longitudinal direction of the rail.

9. The mounting plate according to claim 1, which in a cross-section comprises through holes in the central area of the mounting plate.

10. The mounting plate according to claim 9, which in the circumference of the hole has a second wall, where the mounting plate comprises a second glue pocket between the bottom surface and the second wall, where the second glue pocket in a cross-section has a gradually increasing area from the bottom surface towards the second wall.

11. The mounting plate according to claim 1, where the bottom surface is configured to be glued to the ski, wherein one side edge of the mounting plate in a cross-section of the mounting plate forms a first wall, where the mounting plate comprises a first glue pocket between the bottom surface and the first wall, and where the glue pocket in a cross-section has a gradually increasing area from the bottom surface towards the first wall.

12. The mounting plate according to claim 11, where the first and/or the second glue pocket has a gradually increasing height from the bottom surface towards respectively the first and/or second wall.

13. The mounting plate according to claim 11, where the mounting plate comprises one or more spacer pins which extend down to the same level as the side edges of the mounting plate and are configured to butt against the surface of the ski.

14. The mounting plate according to claim 1, wherein the first and the second wall extend down from the bottom surface such that there is space for a glue layer between the bottom surface and the ski.

15. The mounting plate according to claim 1, configured to hold a changeable fastening element on the forward part of the mounting plate, where the mounting plate and the fastening element comprise respectively one or more first locking elements and one or more second locking elements, the first locking elements and the second locking elements engaging with one another and locking the fastening element in the longitudinal and lateral direction of the mounting plate when the fastening element is arranged from above and down onto the mounting plate.

16. The mounting plate, according to claim 15, which is configured to receive and hold:

a vertical lock configured to lock the first and the second locking elements to one another in the vertical direction.

17. The mounting plate, according to claim 16, where the vertical lock comprises at least one pin configured to be mounted in the longitudinal direction of the mounting plate.

18. The mounting plate, according to claim 17, where the first edge has varying width such that a second area of the first edge forms the second locking element, where the edge comprises at least one first area adjacent the second area), where the first area is wider than the second area, and where the first area has a longitudinal channel configured to receive the vertical lock.

19. The mounting plate, according to claim 18, where the second area and the first locking element both comprise adjacent longitudinal grooves in their side walls configured to form, together, an extension of the longitudinal channel when the fastening element is arranged on the mounting plate.

20. The mounting plate, according to claim 19, where the fastening element comprises two or more first locking elements arranged one after another in the longitudinal direction.

21. The mounting plate, according to claim 20, where the edge comprises at least one third area adjacent the second area, where the third area is wider than the second area, and where the longitudinal channel continues into the third area.

22. A mounting plate system for a ski which comprises the mounting plate of claim 1, and a rail which is one of the first or the second interchangeable rail, wherein the rail in a cross-section has an undercut.

23. The mounting plate system according to claim 22, wherein the rail comprises a binding attachment mechanism configured to lock the ski binding to the rail in the longitudinal direction.

24. The mounting plate system according to claim 22, wherein the binding attachment mechanism is configured to lock the ski binding to the rail in several possible positions in the longitudinal direction.

25. The mounting plate system according to claim 23 where the rail has holes or grooves for receiving a pin, a screw or another fastening element configured to lock the binding to the rail.

26. The mounting plate system according to claim 1, wherein the rail comprises a heel plate attachment mechanism configured to lock a heel plate to the rail in the longitudinal direction.

27. The mounting plate system according to claim 22, where the rail has one or more notches or longitudinal grooves configured to receive one or more complementary pins in the binding, where the notches or the grooves in the rail are configured to take up forces in a lateral direction from the binding via the pins, where the rail is further configured to transfer the forces to the mounting plate.

* * * * *